US006488186B2

(12) United States Patent
Gaiser et al.

(10) Patent No.: US 6,488,186 B2
(45) Date of Patent: Dec. 3, 2002

(54) SYSTEM AND METHOD FOR DISPENSING VISCOUS MATERIAL

(75) Inventors: Rick Gaiser, Spring Grove, IL (US); Val Hierzer, Arlington Heights, IL (US); Bob Simpson, Grayslake, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/973,662

(22) Filed: Oct. 9, 2001

(65) Prior Publication Data

US 2002/0066745 A1 Jun. 6, 2002

Related U.S. Application Data

(63) Continuation-in-part of application No. 09/484,074, filed on Jan. 18, 2000, now Pat. No. 6,315,160.

(51) Int. Cl.[7] ..... B65D 83/00

(52) U.S. Cl. ..... 222/459; 222/494; 222/546

(58) Field of Search ..... 222/145.5, 145.6, 222/212, 424, 459, 494, 546, 564

(56) References Cited

U.S. PATENT DOCUMENTS

| | | | | |
|---|---|---|---|---|
| 4,146,157 A | | 3/1979 | Dixon, Sr. et al. | 222/424 |
| 5,152,432 A | | 10/1992 | De Laforcade | 222/145 |
| 5,310,091 A | | 5/1994 | Dunning et al. | 222/135 |
| 5,509,579 A | | 4/1996 | Robbins, III | 222/109 |
| 5,632,420 A | * | 5/1997 | Lohrman et al. | 222/212 |
| 6,293,437 B1 | * | 9/2001 | Socier et al. | 222/212 |
| 6,315,160 B1 | * | 11/2001 | Gaiser et al. | 222/1 |

* cited by examiner

*Primary Examiner*—Joseph A. Kaufman
(74) *Attorney, Agent, or Firm*—Knoble & Yoshida, LLC

(57) ABSTRACT

A closure for dispensing a viscous material such as mustard or ketchup from a container includes a threaded closure body having a dispensing orifice through which viscous material may flow during dispensing, and a collection space for collecting a volume of thin liquid that may form on top of the viscous material during storage. The collection space acts to intercept the thin liquid as the container is inverted to dispense the viscous material. As the material continues to be dispensed, the thin liquid is re-mixed into the material, thereby keeping the solid to liquid ratio of the material in the container relatively constant. Additionally, a valve may be placed in the orifice for at least partially precluding passage of the thin liquid through the orifice during initial dispensation.

20 Claims, 4 Drawing Sheets

SYSTEM AND METHOD FOR DISPENSING VISCOUS MATERIAL

This is a continuation-in-part of application Ser. No. 09/484,074, now U.S. Pat. No. 6,315,160 filed Jan. 18, 2000, the entire disclosure of which is hereby incorporated as if set forth fully herein.

BACKGROUND OF THE INVENTION

1. Field of the Invention

The invention relates generally to dispensing closures for dispensing containers of the type that are used to store and dispense viscous materials such as mustard and ketchup.

2. Description of the Related Technology

Containers that are used to store and dispense viscous foodstuffs and condiments such as ketchup and mustard employ a wide variety of closures in the United States and throughout the world. One commercially popular closure is shaped as a conical spout, and utilizes a twist-valve to open and close the dispensing passage. A second popular closure has a pivotally mounted snap-lid capable of being moved between a closed and an open dispensing position. In the closed position, the lid covers the dispensing opening and in the open position, the lid is moved away from the opening to allow the product in the container to be dispensed.

One problem that besets viscous foodstuffs such as ketchup and mustard is that thin liquid, e.g. the vinegar and aqueous base of the mixture, tends during periods of nonuse to form at the top of the container as suspended solids settle towards the bottom. When the container is inverted by a user to dispense the material, the thin liquid because of its initial position within the container and its lower viscosity will reach and be expelled from the closure opening before the more viscous material. Many consumers find this discharge of thin liquid to be unpleasant, and would rather not have it on their food. The thin liquid can also aerosolize as it is expelled from the closure and thus spray about in an uncontrolled manner that can make an unpleasant mess.

Consumers are advised to shake the container to mix the viscous material inside before dispensing, but this is often forgotten or avoided. Besides the unpleasant aspects of unmixed dispensing that are described above, premature depletion of the liquids from the suspension of the viscous material can lead to dehydration and thickening of the material.

A need exists for an improved system and method of dispensing viscous materials such as ketchup and mustard that reduces the potential for dribbling, spraying, mess-making and dehydration of the material as a result of early expulsion of the thin liquid component of the material during dispensing.

SUMMARY OF THE INVENTION

Accordingly, it is an object of this invention to provide an improved system and method of dispensing viscous materials such as ketchup and mustard that reduces the potential for dribbling, spraying, mess-making and dehydration of the material as a result of early expulsion of the thin liquid component of the material during dispensing.

In order to achieve the above and other objects of the invention, a closure for dispensing a viscous material from a container includes, according to a first aspect of the invention, securing structure for securing the closure to a container; orifice defining structure for defining an orifice through which a viscous material may flow during dispensing of the viscous material from the container; thin liquid collecting structure for collecting a volume of thin liquid that may form on top of the viscous material during storage, and a valve for permitting flow of viscous material through the orifice during dispensing, the valve being constructed and arranged to impede flow of the thin liquid through said orifice during initial dispensation of fluid through the closure, whereby the amount of thin liquid that will be initially dispensed from the closure will be reduced.

A closure for dispensing a viscous material from a container according to a second aspect of the invention includes a closure body having at least one thread defined on an inner surface thereof for engaging an external thread on a container, a dispensing orifice through which viscous material may flow during dispensing; a collection space for collecting a volume of thin liquid that may form on top of the viscous material during storage and a valve for permitting flow of viscous material through the orifice during dispensing, the valve being constructed and arranged to impede flow of the thin liquid through the orifice during initial dispensation of fluid through the closure, whereby the amount of thin liquid that will be initially dispensed from the closure will be reduced.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
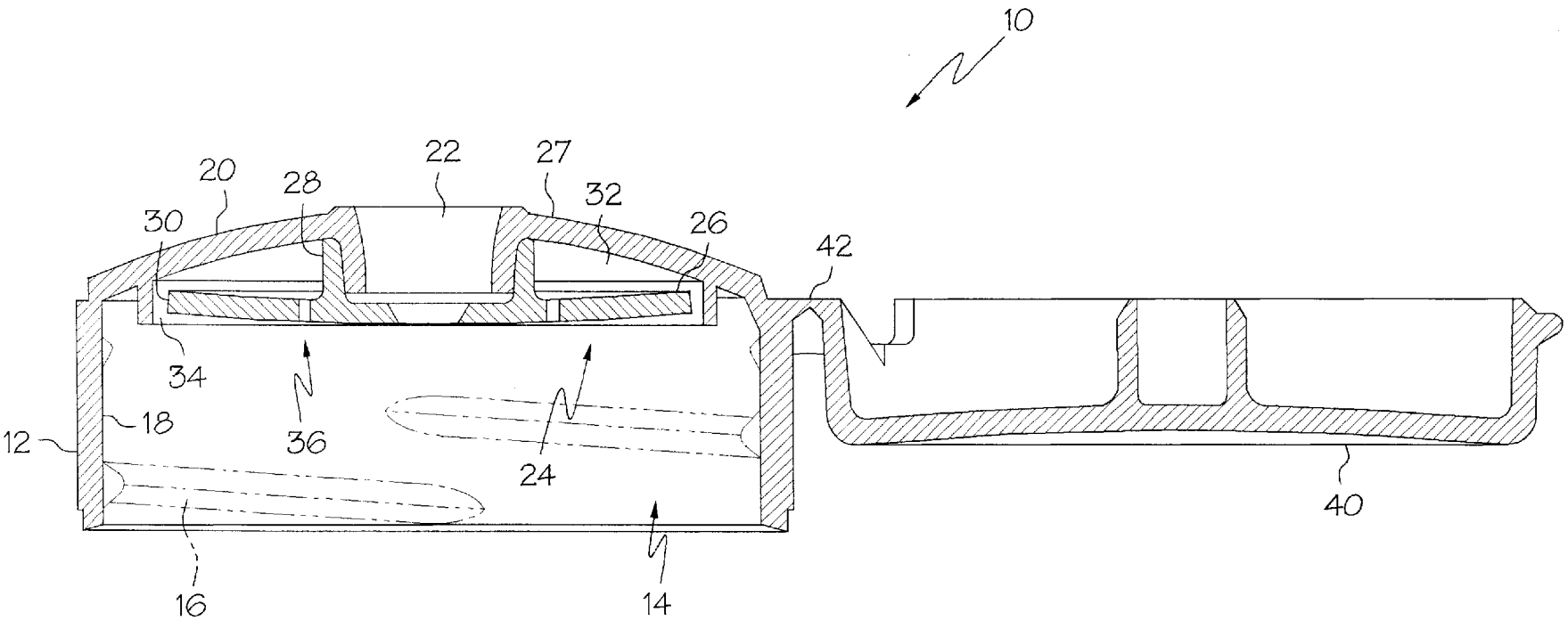
FIG. 1 is a cross-sectional view of a closure that is constructed according to a first embodiment of the invention, shown in a first operative position.
Figure 2:
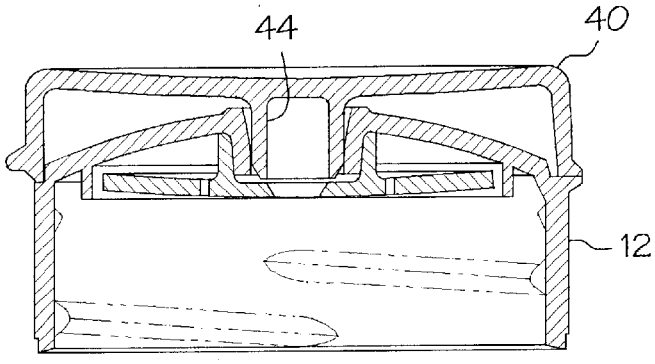
FIG. 2 is a cross-sectional view of the closure shown in FIG. 1, shown in a second operative position.

Referring now to the drawings, wherein like reference numerals designate corresponding structure throughout the views, and referring in particular to FIG. 1, a closure 10 for dispensing a viscous material from a container that is constructed according to a first embodiment of the invention includes a closure body 12 having securing structure 14 for securing the closure 10 to a container, which in the preferred embodiment is constructed as at least one helical thread 16 that is defined on the inner surface 18 of the closure body 12. Alternatively, the securing structure 14 could be embodied as an interference fit, a bayonet or snap connection, or one of many other mechanically equivalent techniques that are well known to those of ordinary skill in this area of technology.

As may further be seen in FIG. 1, closure body 12 includes a top portion 20 that is shaped so as to define an orifice 22, which is preferably, although not necessarily, centered with respect to the top portion 20. According to one important aspect of the invention, structure 24 is provided for collecting a thin liquid that may form on top of the viscous material during storage, so that the amount of thin liquid that will be initially dispensed from the closure 10 will be reduced. In the illustrated embodiment, the thin liquid collecting structure 24 includes a disk-like member 26 that is secured to the interior of the closure body 12 by means of a flange 28 that is pressure-fitted into the structure on the top portion 22 of the closure body 12 that defines the orifice 22. Disk-like member 26, together with the dome 27 that forms the top portion 20 of closure body 12 defines a collection space 32 that may best be seen in FIG. 1.

Figure 4A:
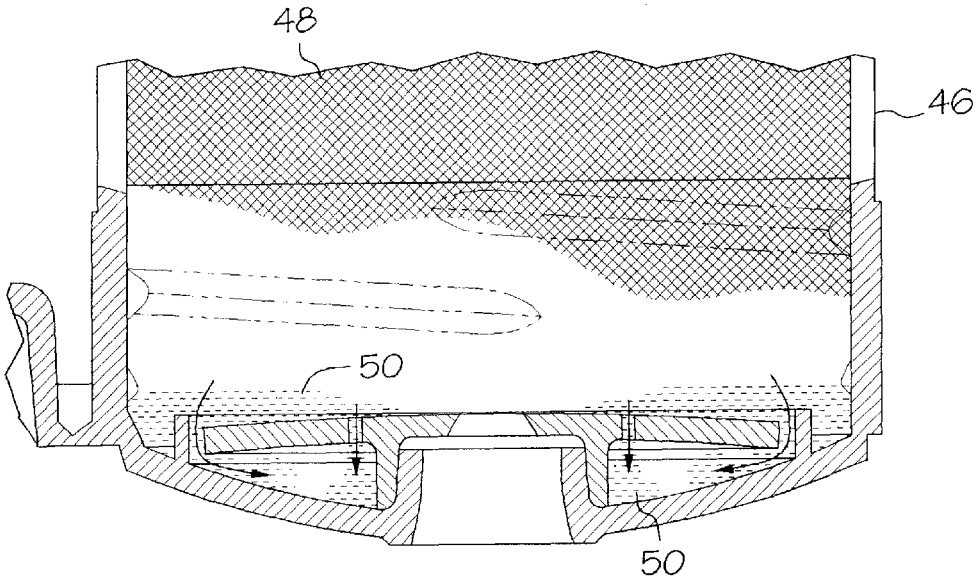
FIGS. 4A and 4B depict a method of dispensing that is performed according to a first embodiment of the invention.
Figure 4B:
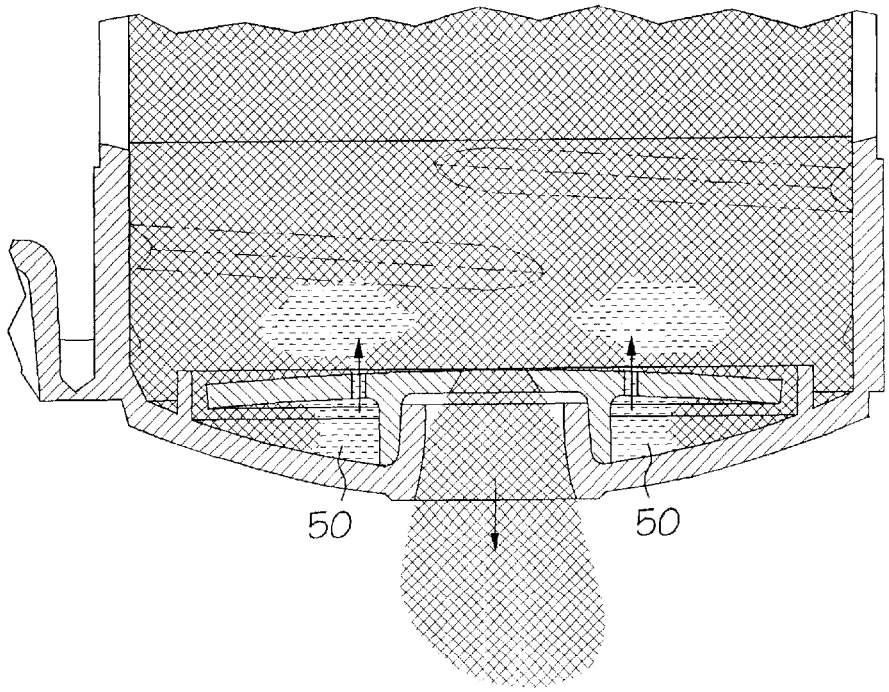

As may further be seen in FIG. 1, the disk-like member 26 has an outer edge 30 that together with the interior of closure body 12 defines a first passageway 34 between the collection space 32 and a space that is in communication with a container during dispensing, as is shown in FIGS. 4(*a*) and 4(*b*). A second passageway 36 is also defined between the collection space 32 and the space that is in communication with the container during dispensing. In the preferred embodiment, the first passageway 34 presents less resistance to flow of the viscous material therethrough than does the second passageway 36, so that the viscous material will enter the collections space through the first passageway as dispensing progresses, thereby displacing thin liquid from the collection space 32 through the second passageway 36. As a result, the thin liquid is re-mixed into the material as it continues to be dispensed. In the preferred embodiment, the second passageway 36 is also closer to the orifice 22 then is the first passageway 34.

Figure 3:
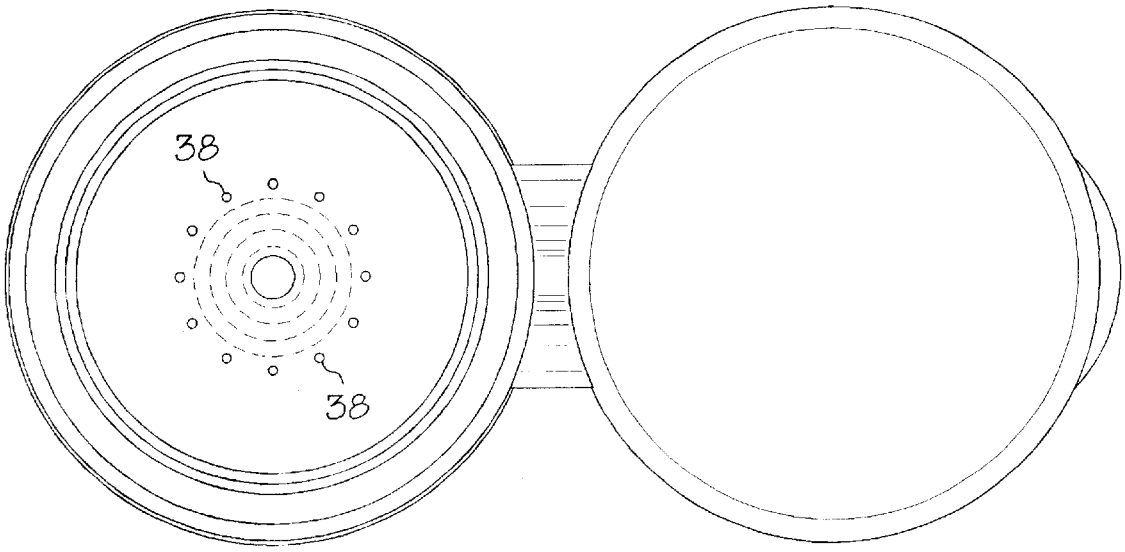
FIG. 3 is a bottom plan view of the closure shown in FIGS. 1 and 2.

As may be seen in FIG. 3, the second passageway is preferably embodied as a plurality of through holes 38 in the disk-like member 26 that are arranged in a circular pattern.

Referring now to FIGS. 4(*a*) and 4(*b*), the operation of closure 10 will be described. Container 46 is first filled with a viscous material 48, such as ketchup or mustard, and the closure 10 is secured to the container 46. The container 46 will then be provided to the consumer in the ordinary course of commerce, and when a consumer desires to dispense viscous material 48 from the container 46, he or she will open the closure 10 and invert the container 46 to the position that is shown in FIG. 4(*a*). The thin liquid 50 that will have collected on top of the the viscous material while it has been stored will tend to run down the inside of the container 46 into the closure 10, and a volume of this thin liquid will be intercepted by the liquid collecting structure 24. More specifically, the thin liquid 50 will be admitted into collection space 32 through the first and second passageways 34, 36. As the consumer continues to invert and squeeze the container 46, the viscous material 48 will make its way into the closure and against the dislike member 26, and as the consumer continues to dispense from the container 46 the viscous material 48 will begin to enter the collection space 32 through the first passageway 34, as shown in FIG. 4(*b*). As this occurs, the volume of thin liquid 50 that has collected in collection space 32 will be displaced from the collection space 32 through the holes 38 in the disk-like member 26 and will be re-mixed into the viscous material 48 before it is expelled from the orifice 22. Accordingly, the thin liquid 50 will be dispensed along with the rest of the viscous material 48, rather than prematurely.

Figure 5A:
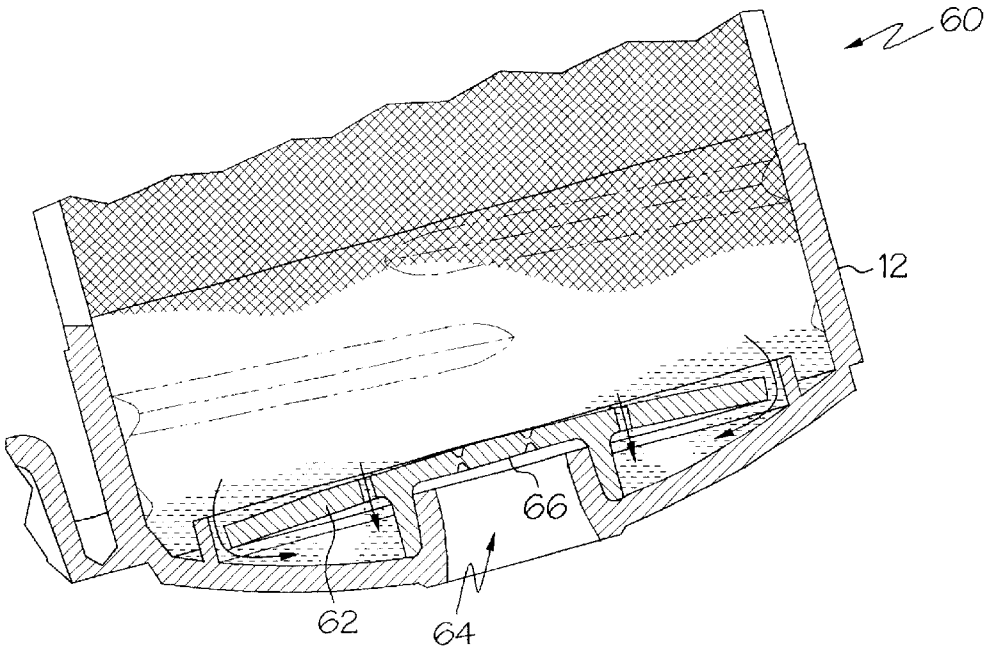
FIGS. 5A and 5B depict a closure that is constructed according to a second embodiment of the invention being used to perform a modified method according to the second embodiment.
Figure 5B:
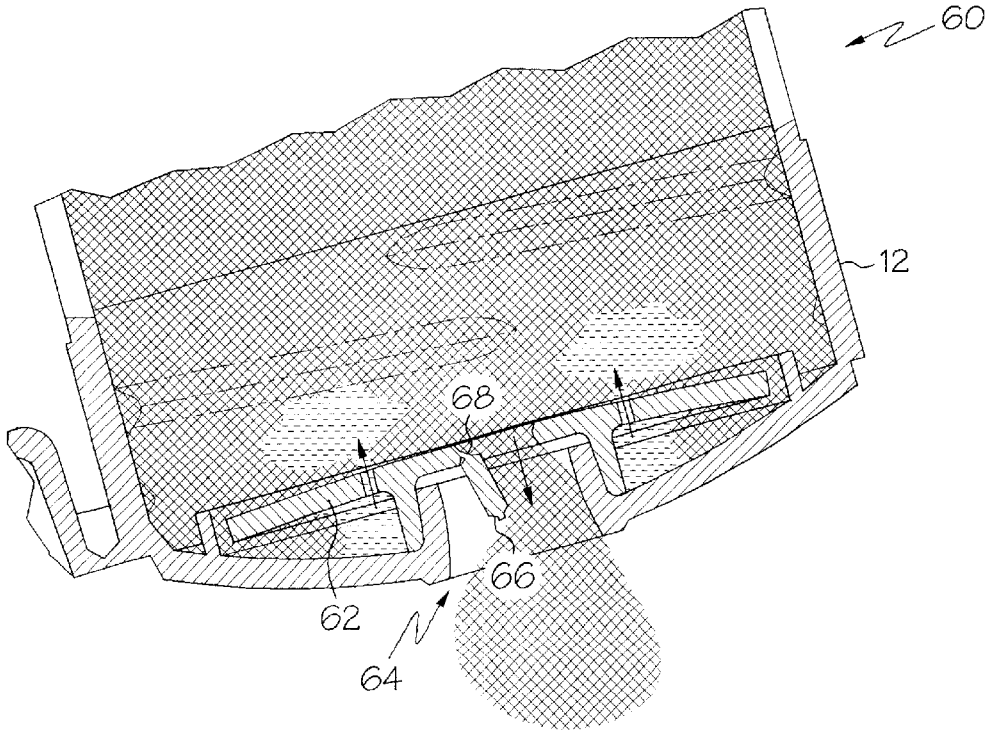

Looking down to FIGS. 5A and 5B, a closure 60 that is constructed according to a second, preferred embodiment of the invention includes a closure body 12 that is constructed in all respects identically to the closure 12 described above with reference to the first embodiment of the invention. Closure 60 further includes a disk like member 62 that is identical in all respects to the disk like member 26 described above with reference to the first embodiment, except that disk like member 62 includes a valve mechanism 64. Valve mechanism 64 is constructed and arranged to permit flow of viscous material through the orifice defined by the closure body 12 during dispensing, but to impede flow of thin liquid through the orifice during initial dispensation of fluid through closure 60. In the preferred embodiment, valve mechanism 64 is constructed as a flapper valve 66 that is integrally molded with the disk like member 62 and that is attached to the disk like member 62 by a thin hinge structure 68. In this embodiment, when a container for a viscous product such as ketchup is inverted, the thin liquid will rush toward the closure 60. When the thin liquid reaches the closure 60, the flapper valve 66 will be positioned as shown in FIG. 5A, and the relatively low viscosity of the thin liquid will be insufficient to force the flapper valve 66 to open. Instead, the thin liquid will take the path of least resistance, and gather within the thin liquid collection space that is defined between the disk like member 62 and the closure body 12, as is explained in greater detail with reference to the first embodiment above.

When the container is squeezed, however, the flapper valve 66 will be forced open by the pressure of the squeezing permitting the viscous product such as ketchup to be dispensed through the dispensing orifice that is defined within the closure body 12. This is shown in FIG. 5B. As this occurs, the thin liquid that is stored within the thin liquid collection space will remix with the viscous product as described above with reference to the first embodiment. As dispensing ceases, the flapper valve 66 will return to the position that is shown in FIG. 5A due to the memory of the hinge structure 68. Air is able to refill the container because the flapper valve 66 does not fully cover the orifice, it has clearance around its periphery.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A closure for dispensing a viscous material from a container, comprising:

securing means for securing the closure to the container;

orifice defining means for defining an orifice through which a viscous material will flow during dispensing of the viscous material from the container;

thin liquid collecting means for collecting a volume of thin liquid that has formed on top of the viscous material during storage, whereby the amount of thin liquid that will be initially dispensed from the closure will be reduced; and valve means for permitting flow of viscous material through said orifice during dispensing, said valve means being constructed and arranged to impede flow of the thin liquid through said orifice during initial dispensation of fluid through said closure.

2. A closure according to claim 1, wherein said valve means comprises a flapper valve positioned in said orifice.

3. A closure according to claim 2, wherein said flapper valve is constructed and arranged to remain substantially closed when contacted by the thin liquid during initial dispensation of fluid through said closure and is further constructed and arranged to open outwardly when the viscous material is dispensed.

4. A closure according to claim 1, wherein said thin liquid collecting means comprises a collection space, a first passageway defined between the collection space and a space that is in communication with the container during dispensing, and a second passageway defined between the collection space and a space that is in communication with the container during dispensing.

5. A closure according to claim 4, wherein said first passageway presents less resistance to flow of the viscous material therethrough than does the second passageway, whereby the viscous material will enter the collection space through the first passageway as dispensing progresses, thereby displacing thin liquid from the collection space through the second passageway to re-mix into the viscous material as it continues to be dispensed.

6. A closure according to claim 5, wherein the second passageway is closer to the orifice than the first passageway.

7. A closure according to claim 4, wherein said thin liquid collecting means comprises a disk member that is affixed to an inner portion of said closure, said disk member defining in part said collection space, and first passageway comprises an annular passage defined between an outer edge of said disk member and an inner surface of the closure.

8. A closure according to claim 7, wherein said second passageway comprises a plurality of holes defined in said disk member.

9. A closure according to claim 7, wherein said valve means is integral with said disk member.

10. A closure according to claim 9, wherein said valve means comprises a flapper valve that is integrally molded into said disk member.

11. A closure for dispensing a viscous material from a container, comprising:

a closure body having at least one thread defined on an inner surface thereof for engaging an external thread on the container, and a dispensing orifice through which viscous material will flow during dispensing;

a collection space for collecting a volume of thin liquid that has formed on top of the viscous material during storage; and valve means for permitting flow of viscous material through said orifice during dispensing, said valve means being constructed and arranged to impede flow of the thin liquid through said orifice during initial dispensation of fluid through said closure, whereby the amount of thin liquid that will be initially dispensed from the closure will be reduced.

12. A closure according to claim 11, wherein said valve means comprises a flapper valve positioned in said orifice.

13. A closure according to claim 12, wherein said flapper valve is constructed and arranged to remain substantially closed when contacted by the thin liquid during initial dispensation of fluid through said closure and is further constructed and arranged to open outwardly when the viscous material is dispensed.

14. A closure according to claim 11, further comprising a first passageway defined between the collection space and a space that is in communication with the container during dispensing, and a second passageway defined between the collection space and a space that is in communication with the container during dispensing.

15. A closure according to claim 14, wherein said first passageway presents less resistance to flow of the viscous material therethrough than does the second passageway, whereby the viscous material will enter the collection space through the first passageway as dispensing progresses, thereby displacing thin liquid from the collection space through the second passageway to re-mix into the viscous material as it continues to be dispensed.

16. A closure according to claim 15, wherein the second passageway is closer to the orifice than the first passageway.

17. A closure according to claim 14, wherein said collection space is defined with respect to said closure by a disk member that is affixed to an inner portion of said closure, and said first passageway comprises an annular passage defined between an outer edge of said disk member and an inner surface of the closure.

18. A closure according to claim 17, wherein said second passageway comprises a plurality of holes defined in said disk member.

19. A closure according to claim 17, wherein said valve means is integral with said disk member.

20. A closure according to claim 19, wherein said valve means comprises a flapper valve that is integrally molded into said disk member.

* * * * *